United States Patent [19]

Brandt

[11] 4,089,278

[45] May 16, 1978

[54] FURNACE, ESPECIALLY A COAL BURNING FURNACE, AND METHOD OF OPERATION

[76] Inventor: Cecil R. Brandt, R.R. #1, Pleasant Lake, Ind. 46779

[21] Appl. No.: 809,059

[22] Filed: Jun. 22, 1977

Related U.S. Application Data

[63] Continuation-in-part of Ser. No. 644,328, Dec. 24, 1975, abandoned.

[51] Int. Cl.[2] ..... F23J 5/02; F22B 9/08

[52] U.S. Cl. ..... 110/206; 122/52; 110/234; 110/345

[58] Field of Search ..... 110/8 R, 18 R, 49 R; 122/52, 390, 391

[56] References Cited

U.S. PATENT DOCUMENTS

| | | | |
|---|---|---|---|
| 1,135,913 | 4/1915 | Nye | 110/49 |
| 1,357,441 | 11/1920 | Burda | 110/49 |
| 1,679,909 | 8/1928 | Michael et al. | 110/49 |
| 1,681,382 | 8/1928 | Torkelson | 110/49 |
| 2,386,193 | 10/1945 | Butts | 122/391 |
| 3,485,191 | 12/1969 | Christman | 110/49 |
| 3,538,865 | 11/1970 | Lausmann | 110/18 |
| 3,742,873 | 7/1973 | Shinpoch | 110/49 |
| 3,799,077 | 3/1974 | Lowe | 110/8 R |

*Primary Examiner*—Kenneth W. Sprague
*Attorney, Agent, or Firm*—Albert L. Jeffers

[57] ABSTRACT

A furnace, especially a coal burning furnace, in which the coal to be burned is placed on a grate near the bottom of a combustion chamber. According to the invention, a fan, or blower, has the inlet and the outlet connected to conduits which lead downwardly at opposite sides of the furnace and turn inwardly into the combustion chamber and blow the flue gases back into the combustion chamber at about 3 inches above the flame center and slightly forward thereof to provide an over and under draft. The conduits extending downwardly from the fan, or blower, at the sides of the boiler preferably have clean-outs at the lower ends thereof, with doors, and solid particles entrained in the flue gas which drop out therefrom can thereby be removed from the conduits. Further, each conduit is preferably provided with a blowdown nozzle at the top to which compressed air can be supplied to blow down the conduit and thereby dislodge solid material that may accumulate therein during operation of the boiler.

17 Claims, 5 Drawing Figures

FURNACE, ESPECIALLY A COAL BURNING FURNACE, AND METHOD OF OPERATION

CROSS-REFERENCE TO RELATED APPLICATIONS

This is a Continuation-in-Part of copending application Ser. No. 644,328, filed Dec. 24, 1975, now abandoned, entitled "Furnace, Especially A Coal Burning Furnace, and Method of Operation," Inventor, Cecil R. Brandt.

BACKGROUND OF THE INVENTION

Field of the Invention

The present invention relates to a furnace especially to coal burning furnaces, and to a method of operation thereof.

In a conventional furnace, such as a coal burning furnace, a combustion chamber is provided which has a grate near the bottom on which the fuel to be burned, such as coal, is placed and ignited. The gases which develop during the combustion of the fuel, and any solid matter therein, are withdrawn from an upper portion of the combustion chamber by way of a closed stack.

The flue gases which enter such a stack from a combustion chamber of the nature referred to contain a considerable amount of unburned solid material and can include gases, such as carbon monoxide which are not completely reduced. Furthermore, the gases are quite hot, ranging up to 600° F, or more.

The described arrangement thus represents an inefficient way for extracting heat from the fuel and considerable loss is represented in the energy conveyed out of the combustion chamber by the hot flue gases.

SUMMARY OF THE INVENTION

According to the present invention, a furnace is provided which may be substantially conventional in construction and configuration and which includes a combustion chamber having a grate near the bottom on which fuel is placed to be burned and from which combustion chamber there leads a stack from the upper portion thereof.

According to the present invention, a fan, or blower, has the inlet side connected to the aforementioned stack, while the outlet side is connected by one or more conduits to the combustion chamber of a furnace about three inches above the flame center and slightly forward thereof. When the fan is operating, flue gases are withdrawn from the stack and blown through the conduit, or down-comers, and enter the combustion chamber in the lateral direction above the flame center and are thus exposed to intensive heat and are further burned.

In this manner, substantially all of the heat content in the fuel is converted into heat by way of combustion and by the repeated combustion of the flue gases; the solids therein are further burned so that any furnace gases are substantially free of solid particles and unreduced gases such as carbon monoxide. The efficiency of combustion of the fuel is thus greatly increased and the smoke from the furnace is greatly reduced, or is substantially eliminated, and a smaller amount of fuel will be required to carry out any heating operations.

In a second furnace embodiment, a boiler is arranged between a horizontally spaced combustion chamber having a grate at the bottom thereof for fuel support, and a combustion smoke stack. A plurality of elongated flues are supported inside the boiler for carrying combustion gases therethrough from the combustion chamber to the stack. Thus, water in the boiler is heated due to its proximity to the combustion chamber at one end and due to the heat transfer through the flue walls between the hot combustion gases and the water. The upper end of the stack has a restricted orifice and a fan, which may be driven by a steam motor having water cooled bearings, is placed with its intake side in fluid communication with the stack and its discharge side in fluid communication with a pair of down-comer pipes which establish fluid communication with the combustion chamber at the fuel level.

Combustion gases from the combustion chamber are drawn by the fan through the flues into the stack. The gases are carried upwardly in the stack to the intake side of the fan wherein they are returned to the combustion chamber. The upward movement of the gases in the stack carry the flue ash and other combustion product particles upwardly, and these particles due to their heavier mass, continue their upward movement past the fan intake and into the cool ambient air being drawn through the orifice. Thus the particles are cooled and chemically combined with the elements in the ambient air coming through the orifice. The particles reverse their upward movement and are drawn into the fan intake for the fan propulsion through the down-comer pipes and into collection traps at the lower ends of the down-comer pipes. Thus, impurities, such as sulphur, are cooled and neutralized permitting the use of a sulphurous coal. The furnace is air tight with the exception of the orifice and an intake draft below the grate to support combustion, and is essentially pollution free. The boiler water is efficiently heated for use in any boiler application.

A stainless steel collector tank has an inlet for receiving excess boiler or machinery steam and a second inlet for receiving a supply of distilled water. The steam heats are distilled water which is pumped, at heated temperatures, e.g. 180° F. - 190° F., to the boiler. The use of the heated water in the boiler provides for a "dry" or super heated steam output from the boiler. The collector requires no softening chemicals to reduce scale and therefore tank cleaning is minimized.

It is therefore an object of this invention to provide a pollution free, high efficiency, furnace combustion chamber.

Another object is the provision of an improved method for burning fuel in a combustion chamber which effects substantial heat economy.

Still another object of this invention is the provision of a method and apparatus for returning hot flue gases to the combustion chamber in position to be further burned by the hot fuel in the combustion chamber.

It is a further object of this invention to provide the chamber of the previous objects in combination with a novel boiler construction for efficient boiler heating.

A still further object of this invention is to provide in the apparatus of the previous objects a boiler water supply which facilitates boiler operation.

Another object of this invention is to provide a steam operated motor to power a fan to aid in combustion gas circulation, with the steam input to the motor being obtainable from the boiler.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
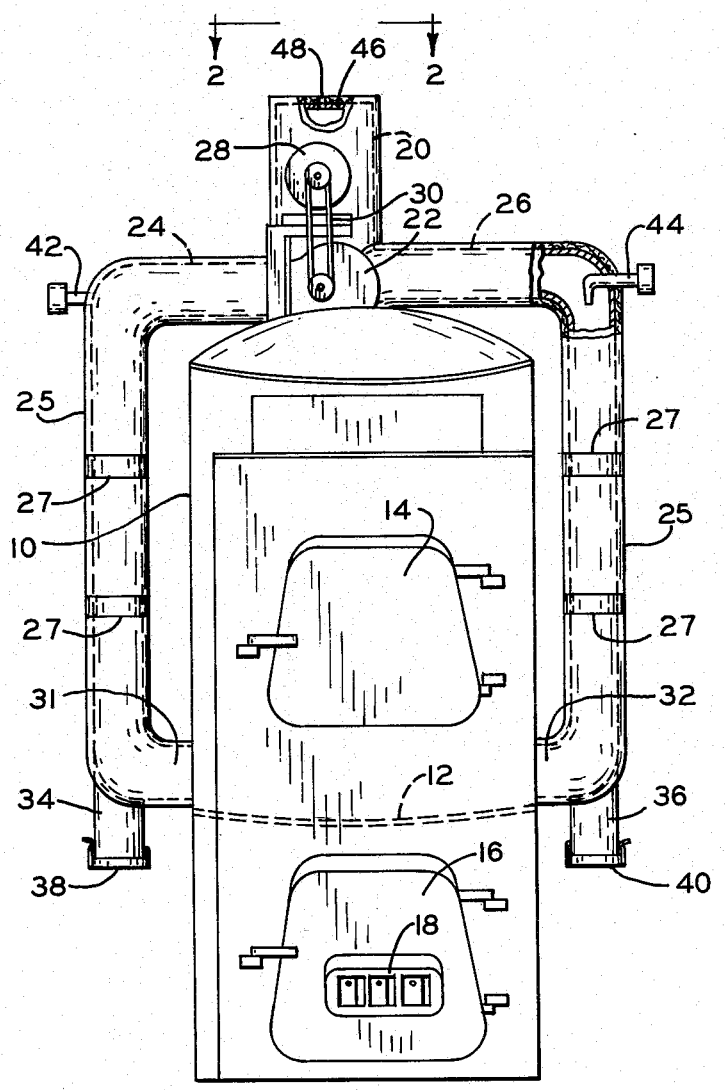
FIG. 1 is a front elevational view of a boiler constructed according to the present invention.
Figure 2:
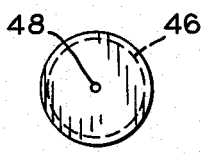
FIG. 2 is a fragmentary plan sectional view, indicated by line 2—2 on FIG. 1.

Referring to FIGS. 1 and 2 of the drawings somewhat more in detail, the furnace illustrated therein is an induced draft coal fired home heating furnace. The practice of the invention is not, however, limited to that specific type furnace but, as will become apparent, it is readily adaptable to other types of furnaces or boilers.

In the drawings, the furnace will be seen to have an outer jacket 10, which may, itself, form the combustion chamber of the furnace and within which is disclosed a grate 12 on which fuel to be burned is disposed. The fuel is introduced into the combustion chamber within jacket 10 by way of a fuel door 14 and ashes can be withdrawn from the furnace from beneath the grate by way of an ash door 16 which may, according to conventional practices, include a draft door 18 therein through which fresh ambient air can be introduced into the space beneath grate 12.

Connected to the upper portion of the combustion chamber within the furnace is a closed stack 20 which receives the products of combustion from the combustion chamber. The closed stack is provided with a small orifice 48 about inch in diameter to let air into the stack to chill inert gases and fly ash. A blower, or fan, 22 is provided having the suction side connected to the stack 20 externally of the furnace and having outlets to which conduits or down-comers 24 and 26 are connected. Blower 22 is adapted for being driven by a variable speed electric motor 28 by way of a drive belt 30.

Conduits 24 and 26 lead laterally outwardly from blower 22 and then downwardly at the sides of the furnace and have the lower ends turned inwardly as at 31, 32 at opposite sides of the furnace and communicate with the combustion chamber a short distance above grate 12 so that gases impelled along the conduits 24, 26 by blower 22 will be blown laterally over the bed of burning fuel on grate 12 for further combustion of the combustible material in the gases.

Each of conduits 24, 26 preferably has a dependent well region 34, 36, respectively, each having a door 38, 40 thereon which can be opened for cleaning out solid material that is collected in the respective well.

Each of the conduits 24, 26 also preferably has a nozzle arrangement 42, 44, respectively, near the upper end of the vertically extending portion of the respective conduit and to which air under pressure can be supplied so as to blow down the respective conduit and dislodge solid material that may accumulate therein during operation of the furnace. This material will, of course, collect in the respective well from which it can readily be removed. The conduits 24 and 26 are provided with insulation 25 such as an asbestos material or the like. The insulation is held in place by straps 27.

The stack 20 is preferably provided with a top cap 46 having an aperture or orifice 48 opening to the atmosphere.

In actual practice, the flue gases are returned to about the same point which point is above the flame center and slightly forward thereof. Stack gas temperature is about 600° F for steel stacks and about 650° F for refractory lined stacks. The temperature of the gases will, of course, drop slightly as the gases are returned to the combustion chamber depending upon the length of the return conduits, the ambient air temperature, the insulation of the conduits and the like. Ash dropped therefrom will accumulate in the clean-outs referred to previously.

The draft available is assumed to be sufficient to effect combustion of about 5 pounds of coal per hour per rated furnace horsepower or equivalent amount of heat output of the furnace.

In a typical installation, the cross sectional area of stack 20 could be about 63.62 square inches, while orifice 48 might be 0.0491 square inches or a fractional part of about 1% of the stack area.

The area of stack 20 is assumed to be 100% effective with no frictional losses and this permits computation of the downcomers 24, 26. The cross sectional area of the down-comers amounts to about 39.3% of the stack cross sectional area.

A variable speed electric motor has been shown as driving the blower 22 but a direct drive such as a steam motor, or the like, can be coupled to the fan, or blower, and the fan shaft bearings are water cooled.

Figures 3, 4, 5:
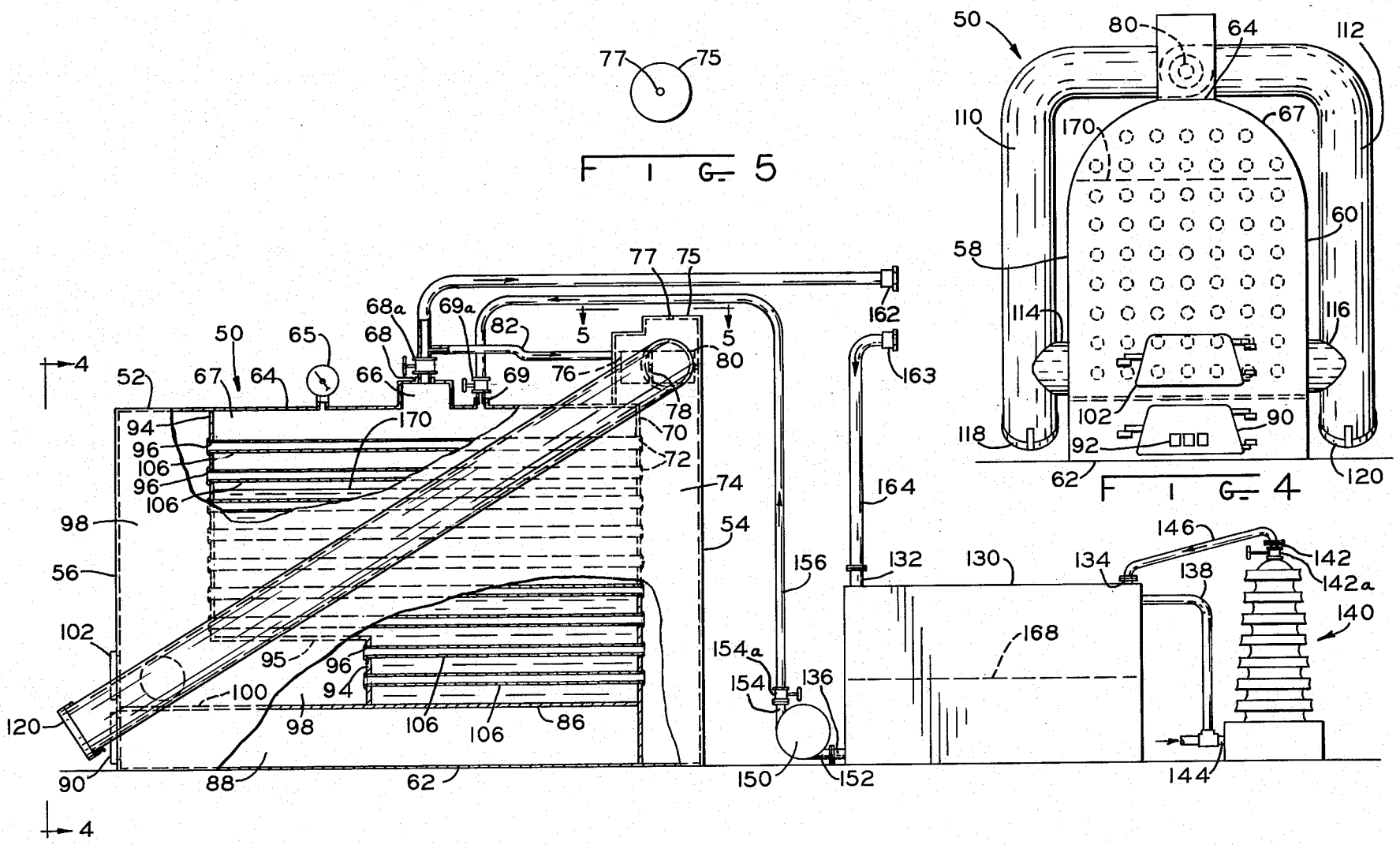
FIG. 3 is a side elevational view, partially broken away, and partially schematic, of a second embodiment of this invention.
FIG. 4 is view taken along line 4—4 of FIG. 3 showing an end view of the boiler of the embodiment of FIG. 3.
FIG. 5 is a view taken at 5—5 of FIG. 3 showing the top of the furnace stack.

Referring now to FIGS. 3 to 5, a second embodiment of this invention will be described. Furnace 50 has an outer housing 52 comprising ends 54, 56 and side walls 58, 60 and bottom 62. Walls 58 and 60 are convexly arcuately curved at their upper portions and are joined by furnace top 26. Attached to top 64 is a pressure gauge 65 and formed in top 64 is a steam chest 66 which is in fluid communication with boiler 67 and is provided with outlet 68. A boiler inlet 69 is also formed in top 64. Adjacent to and horizontally spaced from front wall 54 is a front flue sheet 70 having a plurality of apertures 72 formed therein. The horizontal spacing between end 54 and sheet 70 defines smoke stack 74. Stack 74 has top 75 formed with orifice 77 and in a typical installation the cross sectional area of stack 74 could be 63.62 square inches, while orifice 77 might be 0.0491 square inches or a fractional part of about 1% of the stack area. Mounted in the upper portion of stack 74 is a steam powered motor 76 having water cooled bearings and rotatably driving shaft 78. Also mounted in the upper end of stack 74 immediately adjacent motor 76 is fan or blower 80 mounted to shaft 78 and rotatably driven thereby. Motor 76 may be any of commercially available steam motors well known to the art. A pipe 82 provides fluid communication between outlet 68 and motor 76 to provide the necessary steam power for motor 76.

Mounted between ends 54 and 56 in fluid sealing relation therewith is plate 86 forming an ash pit 88 between floor 62 and plate 86. Ash pit door 90 having draft vent 92 for admitting an unrestricted flow of ambient air to chamber 98 is hinged to the lower portion of end 56 to provide access to pit 88 and air intake to the furnace combustion chamber, next to be described.

A front flue sheet 94, having horizontal shelf 95 formed adjacent the lower end thereof, has a plurality of apertures 96 formed therein horizontally aligned with apertures 72 in sheet 70. Sheet 94 is secured, as by welding in fluid sealing relation with walls 58 and 60, top 64, and plate 86. Sheet 94 is longitudinally spaced from end 56 to define combustion chamber 98. Formed at the lower end of chamber 98 in plate 86 is a grate 100 upon which is placed fuel which typically is coal. As will become apparent, in the operation of the furnace, coal with sulphur content may be burned with the combustion products being completely pollution free. A fuel door 102 is hinged to end wall 56 above grate 100 and provides an opening into chamber 98 for loading of fuel onto grate 100 which extends between end 56 and wall 94. A conventional agitator, not shown, is provided for grate 100 to agitate burned fuel products into pit 88.

Mounted between sheets 70 and 94 in fluid tight relation with corresponding aligned apertures 72 and 96, are a plurality of elongated flues 106. Flues 106 are inserted at each end in their corresponding openings 72, 96, a mandrel is forced in each flue end to expand the flue ends in fluid sealing relation against the periphery of openings 72, 96 and then the flue ends are beaded outwardly against sheets 70 and 94 to provide the fluid tight joint. Other methods of providing fluid tight joints may be employed. Thusly formed, flues 106 provide communication for the hot combustion gases from chamber 98 to stack 74.

Formed on either side of furnace 50 are down-comer tubes 110, 112. The upper ends of the tubes 110 and 112 are in fluid communication with the discharge side of blower 80 and adjacent the lower ends of tubes 110 and 112 are formed pipes 114, 116, respectively, which provide fluid communication between tubes 110, 112 and chamber 98 just above grate 100. Removable covers 118, 120 are placed at the lower ends of tubes 110 and 112, respectively, which, as will become apparent, may be removed for periodic cleaning of collected fly-ash and combustion residue. Boiler 67 is formed in furnace 50 between chamber 98 and stack 74 and is defined by sheets 70 and 94, plate 86, sides 58, 60 and top 64.

A stainless steel collector tank 130 is positioned adjacent furnace 50 and has steam inlet 132, water inlet 134, water outlet 136, and overflow 138, all in fluid communication with the interior thereof. Distilled water generator 140 is positioned adjacent tank 130 and has outlet 142 and inlet 144, supplied with raw water from a source not shown and with distilled water from overflow 138. A pipe 146 is provided in downwardly sloping angle between outlet 142 and inlet 134. A water pump 150 having inlet 152 connected to outlet 136 and outlet 154 in fluid connection to pipe 156 which is connected at its other to inlet 69. A pipe 160 having a tap 162, provides fluid communication between outlet 68 and an electric generator or other steam powered machine, not shown. The exhaust steam from such machinery is connected to inlet 163 and pipe 64 to inlet 132 thus providing for steam passage from such machinery to collector tank 130. Furnace 50 may be coated with asbestos and painted and all joints and connections except ash door 90, vent 92, fire door 102 and orifice 77 are airtight and may be flanged and gasketed to facilitate part removal and replacement. Valves 68*a*, 69*a*, 142*a* and 154*a* are placed respectively at outlet 68, inlet 69, outlet 142, and outlet 154.

In operation of this embodiment, generator 140 provides distilled water to tank 130 to a level 168. Pump 150 pumps distilled water into boiler 67 to level 170 just below spacer 61 and fuel is supplied through door 102 to grate 100 and ignited. Fuel combustion will cause heating of the water in boiler 67 through sheet 94 and shelf 95. The hot combustion gases are drawn through flues 106 and stack 74 blower 80, raising flue 106 temperatures approximately to the temperature of the combustion gases thereby additionally heating the water in boiler 67. The combustion gases are drawn by blower 80 and discharged into tubes 110 and 112 wherein they are forced downwardly into pipes 114 and 116 into combustion chamber 98 at approximately the level of the burning fuel and above the flame center wherein the return combustion gases are recycled into the combustion zone. Thus, complete combustion of the gases is provided. Glowing flue ash particles in stack 74, due to their mass, flow above tubes 110 and 112 to the top of stack 74 wherein they are met with a stream of cool ambient air through orifice 77. The particles are cooled and the sulphur containing particles are chemically and thermodynamically neutralized by the incoming ambient air and after reaching the upperportion of stack 74, are drawn downwardly by blower 80 into tubes 110, 112 wherein they follow the lower surfaces of tubes 110 and 112 to the bottom portion thereof and are collected against covers 118 and 120. Thus, those portions of the combustion gases which are lighter in mass are recycled into the combustion chamber 98 for reburning, and the heavier ash particles are collected against covers 118 and 120 for periodic removal. Complete, polution free combustion is thus provided. With this invention, prewashing of the coal to remove sulphur is unnecessary, thus not only eliminating the pre-washing step but also increasing the fuel heating efficiency since washing the fuel lowers its heating efficiency.

Temperatures in boiler 67 are sufficiently high to generate steam above water level 170 which collects in chest 66 and is conducted by pipe 160 back to collector 130 for preheating the distilled water in tank 130. This results in more efficient boiler operation and a dryer, or hotter, steam in chest 66. Additionally, steam from chest 66 is conducted through pipe 82 to power motor 76. Other uses of the steam may be provided by connection to tap 162. Water from boiler 67 is drawn through outlet, not shown, for circulation in a hot water heating system or other use. When the water level 170 falls, pump 150 is actuated, to pump additional water from tank 168 until the level at 170 is re-established. Level sensing means, not shown but conventional in the art, are provided for this purpose.

When level 168 in tank 130 reaches overflow 138, the water is conducted to inlet 144 of generator 140. Since only distilled water is in tank 130, need for cleaning and scale removal in tank 130 is minimized thus decreasing boiler down-time. Also, the area of orifice 77 is proportional to the length of flues 106, the longer the flue, the larger the orifice.

While there have been described above the principles of this invention in connection with specific apparatus, it is to be clearly understood that this description is made only by way of example and not as a limitation to the scope of the invention.

What is claimed is:

1. In a combustion system furnace; a combustion chamber having a grate at the bottom to support material to be burned, a stack in fluid communication with said combustion chamber, fan means connected to the stack and operable for withdrawing gases therefrom, conduit means for fluid communication between the discharge side of said fan means and said combustion chamber above said grate, first means comprising a fixed orifice in said stack for restricting flow of ambient air into said stack to be predetermined limited flow, second means for admitting flow of ambient air in unrestricted quantities into the combustion chamber below said grate.

2. The system of claim 1 wherein said stack has a predetermined cross-sectional area, said first means comprising a fixed orifice in the said stack for providing flow between the ambient air and the suction side of the said fan, said orifice having an area in the order of one percent of said stack cross-sectional area.

3. The system of claim 1 with trap means with clean out door means in said conduit means near the lower end thereof to receive solids entrained in the gases flowing in said conduit means.

4. The system of claim 3 including means in said conduit means near the upper end thereof for blowing air downwardly in said conduit means to dislodge solids which may accumulate therein into said trap means.

5. The method of combusting which comprises the steps of: supporting combustible material on a grate near the bottom of a combustion chamber and igniting the material, withdrawing the combustion gases from the chamber near the top thereof, admitting a predetermined limited quantity of ambient air through a fixed orifice into the withdrawn gases, blowing the withdrawn gases above the flame center, admitting an unrestricted flow of ambient air to the combustion material below the flame center.

6. In a furnace; a combustion chamber having a grate at the bottom to support material to be burned, a stack in fluid communication with said combustion chamber, fan means connected to the stack and operable for withdrawing gases therefrom, conduit means for fluid communication between the discharge side of said fan means and said combustion chamber above said grate, first means for restricting flow of ambient air into said stack to a predetermined limited flow, second means for admitting flow of ambient air in unrestricted quantities below said grate, said conduit means comprises a pair of conduits extending from the discharge side of said fan means downwardly along each side of the furnace and into the combustion chamber above said grate on respective sides of said chamber, each said conduit having trap means therein near the lower end and each conduit also having means for blowing air downwardly therein.

7. A system according to claim 6 which includes a variable speed electric motor driving said fan means.

8. A system according to claim 6 in which the combined cross sectional areas of said conduits is less than the cross sectional area of said stack.

9. A system according to claim 1 in which said conduit means comprises a pair of conduits extending from the discharge side of said fan means downwardly along each side of the furnace and into the combustion chamber above said grate on respective sides of said chamber, each said conduit having trap means therein near the lower end and each conduit having means for blowing air downwardly therein.

10. In a combustion system furnace for a boiler; a boiler having first and second horizontally spaced ends; an enclosed combustion chamber having a grate at the bottom to support fuel to be burned being at said first end; a stack being at said second end; fan means having an intake side connected to said stack and operable to withdraw gases therefrom; conduit means for providing enclosed fluid passage between the discharge side of the fan means and said combustion chamber above said grate; first means comprising a fixed orifice in said stack on the intake side of said fan means for restricting flow of ambient air into said stack to a predetermined limited flow; second means for admitting flow of ambient air in unrestricted quantities into the combustion chamber below said grate.

11. The system of claim 10 including flue means for providing an enclosed fluid passage through said boiler between said chamber and said stack to the intake side of said fan means to provide enclosed combustion gas passage through said boiler to said stack.

12. The system of claim 11 wherein said flue means comprises a plurality of substantially parallel, elongated, transversely spaced flues.

13. The system of claim 12 including a first substantially vertical flue sheet between said chamber and said boiler; said flue sheet having a plurality of openings therein; first ends of said flues being in fluid tight relation with said openings; a second substantially vertical flue sheet being between said boiler and said stack and having a second plurality of openings therein; second ends of said flues being in fluid tight relation with said second openings.

14. The system of claim 10 wherein said conduit means comprises a pair of down-comer tubes one of said tubes being on one side of said stack and the other of said tubes being on the other side of said stack.

15. The system of claim 10 wherein said orifice is at the upper end of said stack; said conduit means having trap means at the chamber end thereof for receiving particles from said stack; said conduit means being connected to said stack below said orifice whereby heavier smoke particles will be carried upwardly in said stack beyond said fan means and into the restricted flow from said orifice after which said particles will be carried by fan means through said conduit means to said trap means.

16. The system of clam 10 wherein said fan means comprises a steam motor in driving relation to a fan; a steam outlet being on said boiler in fluid power communication with said motor.

17. The system of claim 10 including a collector tank; first box inlet for receiving steam into said tank; a second tank inlet for receiving distilled water; a tank outlet and pumping means for pumping distilled water from said tank outlet into said boiler.

* * * * *